US005701552A

United States Patent [19]

Stephany et al.

[11] Patent Number: 5,701,552

[45] Date of Patent: Dec. 23, 1997

[54] ELECTROGRAPHIC PRINTER COMPRISING A MAGNETIC BRUSH AND A HALL EFFECT MAGNETIC SENSOR

[75] Inventors: Thomas M. Stephany, Churchville; William Mey, Rochester; Edward P. Furlani, Lancaster, all of N.Y.

[73] Assignee: Eastman Kodak Company, Rochester, N.Y.

[21] Appl. No.: 659,810

[22] Filed: Jun. 7, 1996

[51] Int. Cl.[6] ..... G03G 15/09

[52] U.S. Cl. ..... 399/53; 347/55; 399/267

[58] Field of Search ..... 399/53, 267, 277; 347/55

[56] References Cited

U.S. PATENT DOCUMENTS 3,914,771 10/1975 Lunde et al. ..... 346/74.2

4,454,520 6/1984 Braschler et al. ..... 347/55

5,444,470 8/1995 Muto et al. ..... 347/55 X

*Primary Examiner*—Arthur T. Grimley

*Assistant Examiner*—Sophia S. Chen

*Attorney, Agent, or Firm*—Thomas H. Close

[57] ABSTRACT

An electrographic printer includes: a magnetic brush having a stationary outer shell and a rotating multi-pole magnet within the outer shell; an electrographic print head mounted on the outer shell of the magnetic brush; a Hall effect sensor located adjacent to the magnetic brush for detecting a field produced by the multi-pole magnet parallel to the surface of the shell and producing an output signal; and a pulse control circuit connected to the Hall effect sensor for detecting zero crossings of the output signal and supplying printing pulses to the electrographic print head in response thereto.

2 Claims, 2 Drawing Sheets

ELECTROGRAPHIC PRINTER COMPRISING A MAGNETIC BRUSH AND A HALL EFFECT MAGNETIC SENSOR

FIELD OF THE INVENTION

The invention relates generally to the field of electrographic printers, and in particular to developer handling systems in electrographic printers. More specifically, the invention relates to a device for sensing the rotational position of a magnetic brush in the developer handling system.

BACKGROUND OF THE INVENTION

U.S. Pat. No. 3,914,771, issued Oct. 21, 1975, to Lunde et al shows an electrographic printer which selectively transfers toner particles directly onto a receiver. As shown in FIG. 1, the printer includes an electrostatic print head 10 placed upon or next to the non-rotating shell 12, of a magnetic brush 14. The shell 12 encloses a rotating, radially polarized, multi-pole cylindrical magnet 16. A developer 18 contained in a sump 20 is delivered to the magnetic brush 14 by a magnetic delivery roller 22. The magnetic brush 14 causes the developer 18, which contains toner as a component, to be transported over the shell 12 towards the print head 10. The particles of developer move in columns which alternatively stand up and lie down as the magnet 16 rotates inside the shell 12 of the magnetic brush 14. Thus, the columns of developer are stepped along the surface of the shell and across the electrostatic print head 10. When the developer is in proper position over a plurality of transfer electrodes (not shown) on the print head 10 and immediately beneath the receiver, the electrodes are activated by a pulse control circuit 24 so as to transfer toner particles from the surface of the print head 10, across a gap, and onto a receiver 26. The receiver 26 is transported by a receiver drum 27, which is driven by a motor 29 connected to the pulse control circuit 24.

To optimize the transfer of toner, and enhance the quality of the transferred image, the transfer electrodes in the print head 10 should be energized when the developer columns are vertical and perpendicular to the surface of shell 12. This, in turn, occurs when the magnetic field generated by the multi-pole magnet 16 is itself perpendicular to the shell surface, since the carrier particles align themselves with this field. To detect the instant in time that the magnetic field is perpendicular, Lunde et al. provide an encoder wheel 28 on the end of the multi-pole magnet 16 having a reflective patch 30 at the leading edge of each magnetic pole. An optical sensor 32 senses the reflective patches and provides a timing signal to the pulse control circuit 24. While this sensing technique functions adequately when properly aligned, manufacturing tolerances in the uniformity of the physical dimensions and polarization of the magnet sectors can cause the sensor to inaccurately represent the instant in time when the magnetic field is perpendicular to the shell at the recording head, resulting in less than optimum performance of the printer. Therefore, a need exists to provide an improved means for sensing the rotational position of the multi-pole magnet.

SUMMARY OF THE INVENTION

The present invention is directed to overcoming one or more of the problems set forth above. Briefly summarized, according to one aspect of the present invention an electrographic printer includes: a magnetic brush having a stationary outer shell and a rotating multipole magnet within the outer shell; an electrographic print head mounted on the outer shell of the magnetic brush; a Hall effect sensor located adjacent to the magnetic brush for detecting a field produced by the multi-pole magnet parallel to the surface of the shell and producing an output signal; and a pulse control circuit connected to the Hall effect sensor for detecting zero crossings of the output signal and supplying printing pulses to the electrographic print head in response thereto.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The disclosed sensing device is inexpensive and easy to manufacture and is capable of a high degree of angular resolution because it is extremely sensitive to the angular position of the magnetic brush, relative to the optimum angular position in which the field is perpendicular to the print head electrode. At this point the developer columns are vertical and optimum for the transfer of toner to the receiver. Moreover, the angular resolution of this sensing method is high because the sensor will detect a significant azimuthal field component immediately to the left or right of this center position. Furthermore, it will be a sensitive measure of whether the field, and hence the developer column, is leading or lagging the print head array. This is because the azimuthal field component changes direction as it passes through the center position, which occurs at the center of a pole.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
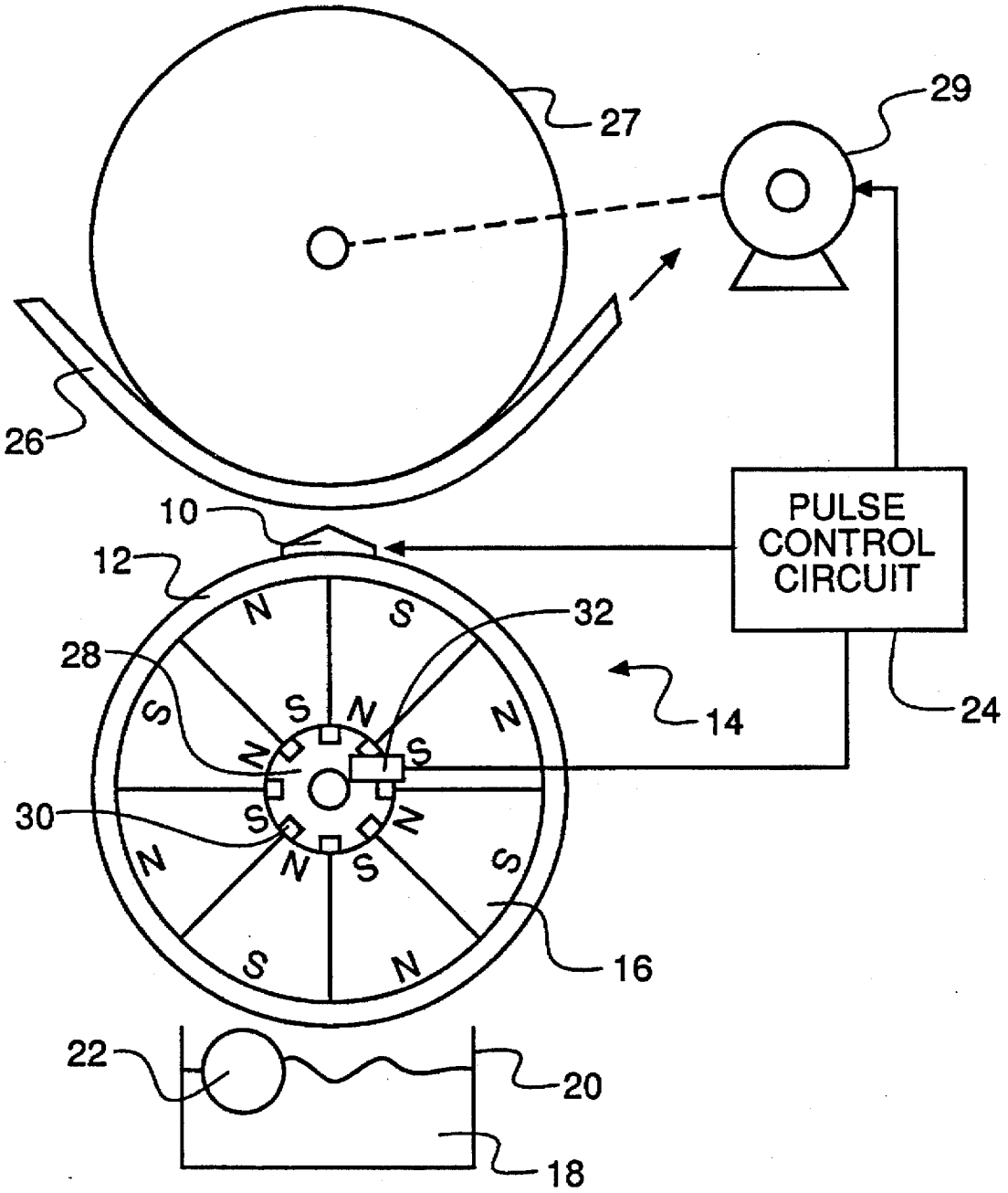
FIG. 1 (PRIOR ART)
FIG. 1 is a schematic diagram of a prior art electrographic apparatus.
Figure 2:
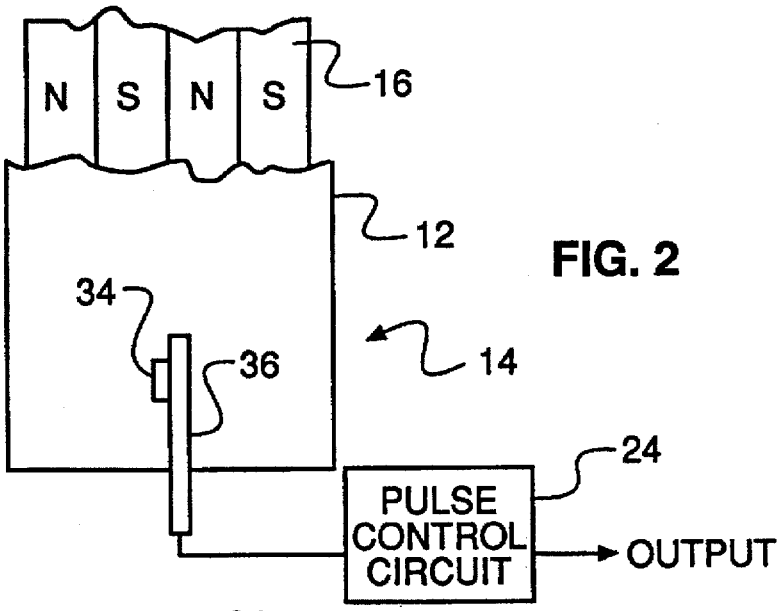
FIG. 2 is a partial top view of the magnetic brush and improved sensing device of the present invention.
Figure 3:
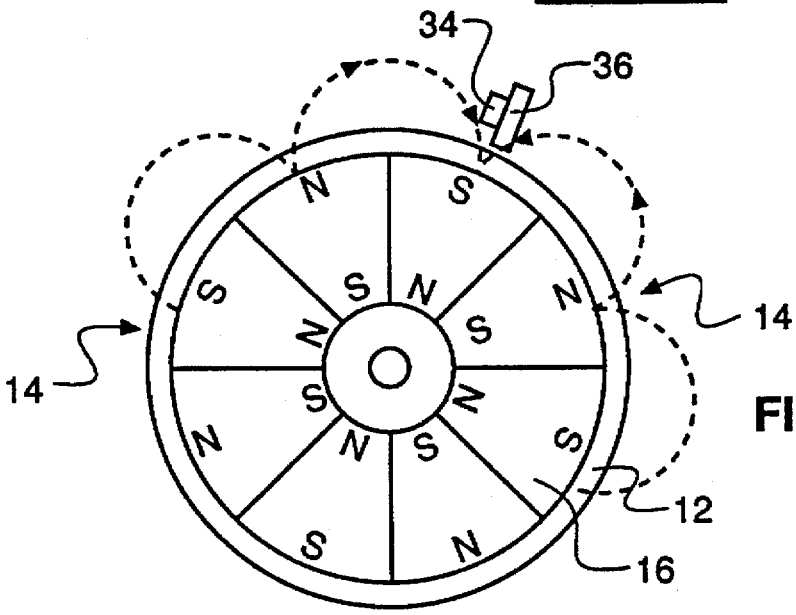
FIG. 3 is an end view of the magnetic brush and improved sensing device of the present invention.

Referring to FIGS. 2 and 3, the improved sensor according to the present invention includes a Hall effect magnetic sensor 34 mounted on a bracket 36 and located over the magnetic brush 14 to sense the direction of the magnetic field at the sensor location. Preferably, the Hall effect sensor 34 is oriented to sense a field parallel to the surface of the shell 12 and therefore produces zero output signal when the field is perpendicular to the shell. Preferably, the Hall effect sensor 34 is located in the same plane as the print head 10. The output of the Hall effect sensor 34 is sent to the pulse control circuit 24 to control the activation of the transfer electrodes in the print head 10. A suitable Hall sensor for the present application is an analog type Hall sensor, for example the THS 108A sensor sold by Toshiba Ltd., Japan.

Figure 4:
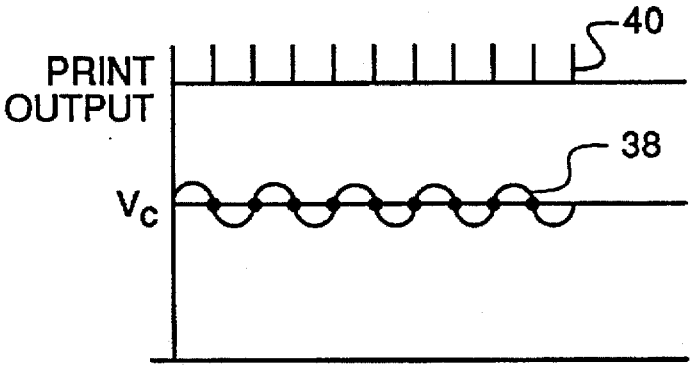
FIG. 4 is a timing diagram useful in describing the operation of the improved sensing device of the present invention.

In operation, the sensor 34 is mounted in proximity to the surface of the shell 12 to sense a magnetic field parallel to the surface. In this position, the Hall sensor will sense zero field when the field is strictly vertical over the print head 10 (i.e. the optimum field). As shown in FIG. 4, the Hall sensor 34 produces a sinusoidal output voltage 38 about a Hall supply voltage Vc as multi-pole magnet 16 rotates within shell 12. The pulse control circuit 24 includes a zero crossing detector for producing a stream of timing pulses 40 which indicate the optimum print timing for the electrographic print head 10.

The present invention is also useful for detecting the location of the magnetic pole transitions in a magnetic brush of the type wherein the outer shell rotates.

The invention has been described with reference to a preferred embodiment. However, it will be appreciated that variations and modifications can be effected by a person of ordinary skill in the art without departing from the scope of the invention.

10 print head
12 shell
14 magnetic brush
16 multi-pole cylindrical magnet
18 developer
20 sump
22 magnetic delivery roller
24 pulse control circuit
26 receiver
27 receiver drum
28 encoder wheel
29 drive motor
30 reflective patch
32 optical sensor
34 Hall effect magnetic sensor
36 mounting bracket
38 sinusoidal output voltage
40 timing pulses

We claim:

1. An electrographic printer, comprising:

a) a magnetic brush having an outer shell and rotating multi-pole magnet within the outer shell;

b) an electrographic print head mounted next to the outer shell of the magnetic brush;

c) a Hall effect sensor located adjacent to the magnetic brush for detecting a field produced by the multi-pole magnet parallel to the surface of the shell and producing a sinusoidal output signal, the Hall sensor producing zero output signal when the field is perpendicular to the outer shell; and d) a pulse control circuit connected to the Hall effect sensor generating and supplying printing pulses to the electrographic print head, when the sinusoidal output crosses zero.

2. The electrographic printer claimed in claim 1, wherein the Hall effect sensor is an analog Hall effect sensor.

* * * * *